US008445795B2

(12) United States Patent
Vaziri et al.

(10) Patent No.: US 8,445,795 B2
(45) Date of Patent: May 21, 2013

(54) MULTI FUNCTION NAVIGATIONAL SWITCH

(75) Inventors: Seyamak Vaziri, San Jose, CA (US); Nguyen Nguyen, San Jose, CA (US); Anthony Mitchell, Colfax, CA (US)

(73) Assignee: Cisco Technology, Inc., San Jose, CA (US)

( * ) Notice: Subject to any disclaimer, the term of this patent is extended or adjusted under 35 U.S.C. 154(b) by 270 days.

(21) Appl. No.: 12/902,794

(22) Filed: Oct. 12, 2010

(65) Prior Publication Data

US 2012/0085629 A1 Apr. 12, 2012

(51) Int. Cl.
*H01H 25/04* (2006.01)

(52) U.S. Cl.
USPC ..... 200/5 R; 200/6 A

(58) Field of Classification Search
USPC ..... 200/5 R, 6 A, 17 R, 18, 512, 517
See application file for complete search history.

(56) References Cited

U.S. PATENT DOCUMENTS 4,256,931 A * 3/1981 Palisek ..... 200/5 A
4,947,461 A * 8/1990 Yoshioka et al. ..... 200/5 R
6,329,614 B1 * 12/2001 Miyashita ..... 200/5 R
6,388,210 B1 * 5/2002 Nisse ..... 200/6 A
6,961,052 B1 11/2005 Vaziri
7,094,979 B2 * 8/2006 Kurokawa et al. ..... 200/5 R
7,421,469 B1 9/2008 Liu et al.
7,512,964 B2 3/2009 Rodriguez et al.
7,764,960 B2 7/2010 McClung
7,907,564 B2 3/2011 Laux et al.
2006/0137961 A1 * 6/2006 Lin et al. ..... 200/6 A
2009/0188781 A1 * 7/2009 Ikeda ..... 200/5 R
2010/0258425 A1 * 10/2010 Takahashi et al. ..... 200/512

* cited by examiner

*Primary Examiner* — Michael Friedhofer
(74) *Attorney, Agent, or Firm* — BainwoodHuang

(57) ABSTRACT

An assembly includes an electronic device having depressible controls and a navigation button which is positioned over the electronic device. The navigation button has a central portion, and directional lobes extending from the central portion. The navigation button initially resides in a non-pivoting orientation in which none of the depressible controls are actuated. The navigation button (i) pivots about a first axis in response to depression of a first directional lobe to actuate a first depressible control of the electronic device without actuating a second depressible control of the electronic device, and (ii) pivots about a second axis in response to depression of a second directional lobe to actuate the second depressible control of the electronic device without actuating the first depressible control of the electronic device. Each of the first axis and the second axis is offset from a midpoint of the navigation button.

20 Claims, 5 Drawing Sheets

MULTI FUNCTION NAVIGATIONAL SWITCH

TECHNICAL FIELD

The present disclosure relates generally to navigation button assemblies. Such an assembly can enable a user to direct movement of a pointer (e.g., a highlighted field, an arrow, a cursor, etc.) across an electronic display of an electronic apparatus.

BACKGROUND

In a conventional 4-way navigation mechanism, a navigation button having four directional tabs (e.g., North, South, East and West) sits over four corresponding resistance-varying sensors which incrementally vary in resistance depending on how much the resistance-varying sensors are compressed. When a user pushes down on a particular tab to specify a direction, the navigation button pivots about an axis which extends through the midline of the navigation button. In response, the resistance-varying sensor directly underneath the particular tab undergoes maximum compression and provides maximum resistance, and the adjacent resistance-varying sensors undergo partial compression and provide moderate resistance.

A programmed processor, which electrically connects to each of the four resistance-varying sensors, measures the resistance provided by each resistance-varying sensor to discern the direction specified by the user. For example, if the user presses the rightmost tab of the navigation button to specify East, the programmed processor measures (i) maximum resistance from the resistance-varying sensor directly underneath the rightmost tab due to maximum compression and (ii) moderate resistance from the adjacent resistance-varying sensors, i.e., North and South, due to partial compression. The programmed processor concludes that the user has specified East since the resistance-varying sensor directly underneath the rightmost tab provides the highest resistance.

BRIEF DESCRIPTION OF THE DRAWINGS

The foregoing and other objects, features and advantages will be apparent from the following description of example embodiments, and as illustrated in the accompanying drawings in which like reference characters refer to the same parts throughout the different views. The drawings are not necessarily to scale, emphasis instead being placed upon illustrating the principles of various example embodiments.

DESCRIPTION OF EXAMPLE EMBODIMENTS

Overview

An improved technique utilizes a multi function navigational switch having a navigation button which is capable of pivoting about multiple axes in order to actuate particular underlying controls (e.g., about a first axis when a rightmost lobe is depressed, and a second axis when a leftmost lobe is depressed). Such operation enables a user to depress exactly one underlying control at a time when depressing the navigation button. Accordingly, such operation alleviates the need for resistance-varying sensors and a programmed processor to discern user input based on comparing measured resistance from the resistance-varying sensors.

One embodiment is directed to a navigation button assembly including an electronic device having a set of depressible controls, a support (e.g., cover) disposed in a fixed position relative to the electronic device, and a navigation button which is positioned over the electronic device by the support. The navigation button has (i) a central portion, and (ii) directional lobes extending from the central portion. The navigation button is constructed and arranged to initially reside in a non-pivoting orientation in which none of the depressible controls are actuated. The navigation button is further constructed and arranged to (i) pivot about a first axis relative to the support in response to depression of a first directional lobe to actuate a first depressible control of the electronic device without actuating a second depressible control of the electronic device, and (ii) pivot about a second axis relative to the support in response to depression of a second directional lobe to actuate the second depressible control of the electronic device without actuating the first depressible control of the electronic device. Each of the first axis and the second axis is offset from a midpoint of the navigation button.

Another embodiment is directed to an electronic apparatus having a base, an electronic display coupled to the base, and a navigation button assembly similar to that described above. In some embodiments, the electronic apparatus includes telephone circuitry enabling the electronic apparatus to operate as a telephone (e.g., an IP phone, a smart phone, an intelligent analog phone, etc.) with electronic features (e.g., displayable and selectable telephone functions).

DETAILED DESCRIPTION

Figure 1:
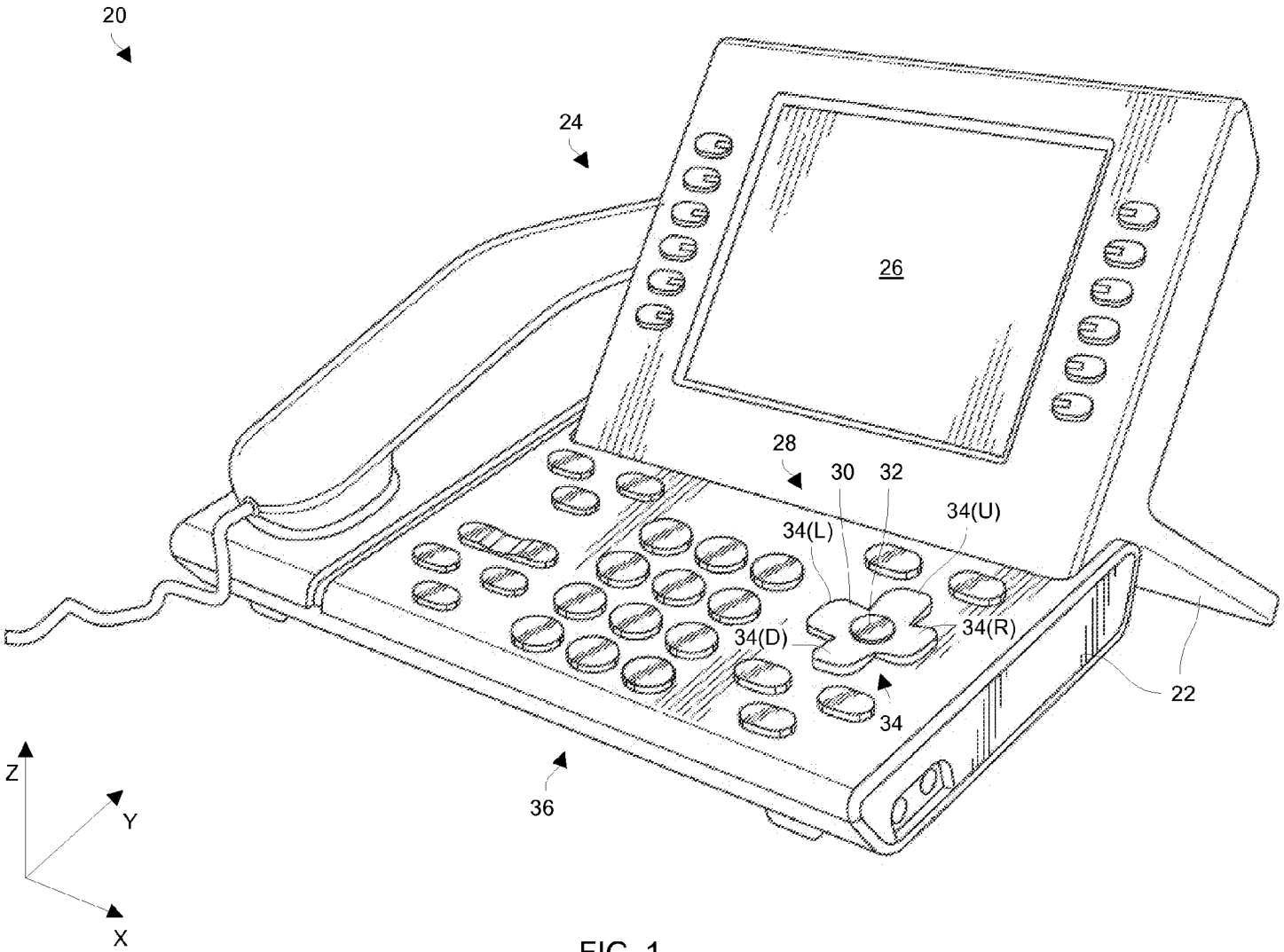
FIG. 1 is a perspective view of an electronic apparatus having a navigation button assembly which is capable of receiving navigation control from a user.

FIG. 1 shows an electronic apparatus 20 having a base (or frame structure) 22 and a set of input/output (I/O) components 24 supported by the base 22. The set of I/O components 24 includes an electronic display 26 and a navigation button assembly 28. The set of I/O components 24 can include other input and output elements as well such as lights, a speaker, a microphone, connectors, and so on.

The navigation button assembly 28 has a navigation button 30 and a selection button 32 which are directly accessible to a user. The navigation button 30 has a set of directional lobes 34(U), 34(D), 34(L) and 34(R) (collectively, directional lobes 34) which receive directional input (e.g., up, down, left, right) from the user. The selection button 32 receives selection input from the user.

For example, to highlight a particular item (or move a pointer in a particular direction) on the electronic display 26, the user presses on a directional lobe 34 of the navigation button 30 in the negative Z-direction. The user can then press a different directional lobe 34 or the same directional lobe 34 to further advance across the electronic display 26. Additionally, to select a currently highlighted item on the electronic display 26, the user presses the selection button 32 in the negative Z-direction.

In some arrangements, the electronic apparatus 20 is a telephone (e.g., an IP phone) which provides a user with robust and reliable phone functionality (e.g., session activation, call forwarding, call conferencing, and so on). Along these lines, the navigation button assembly 28 communicates with telephone circuitry 36 (illustrated generally by the arrow 36 in FIG. 1) enabling the user to provide 5-way navigational input (e.g., up, down, left, right and select) for enhanced operability (e.g., to move between sessions, to scroll through session information, etc.). Further details will now be provided with reference to FIGS. 2 and 3.

Figure 2:
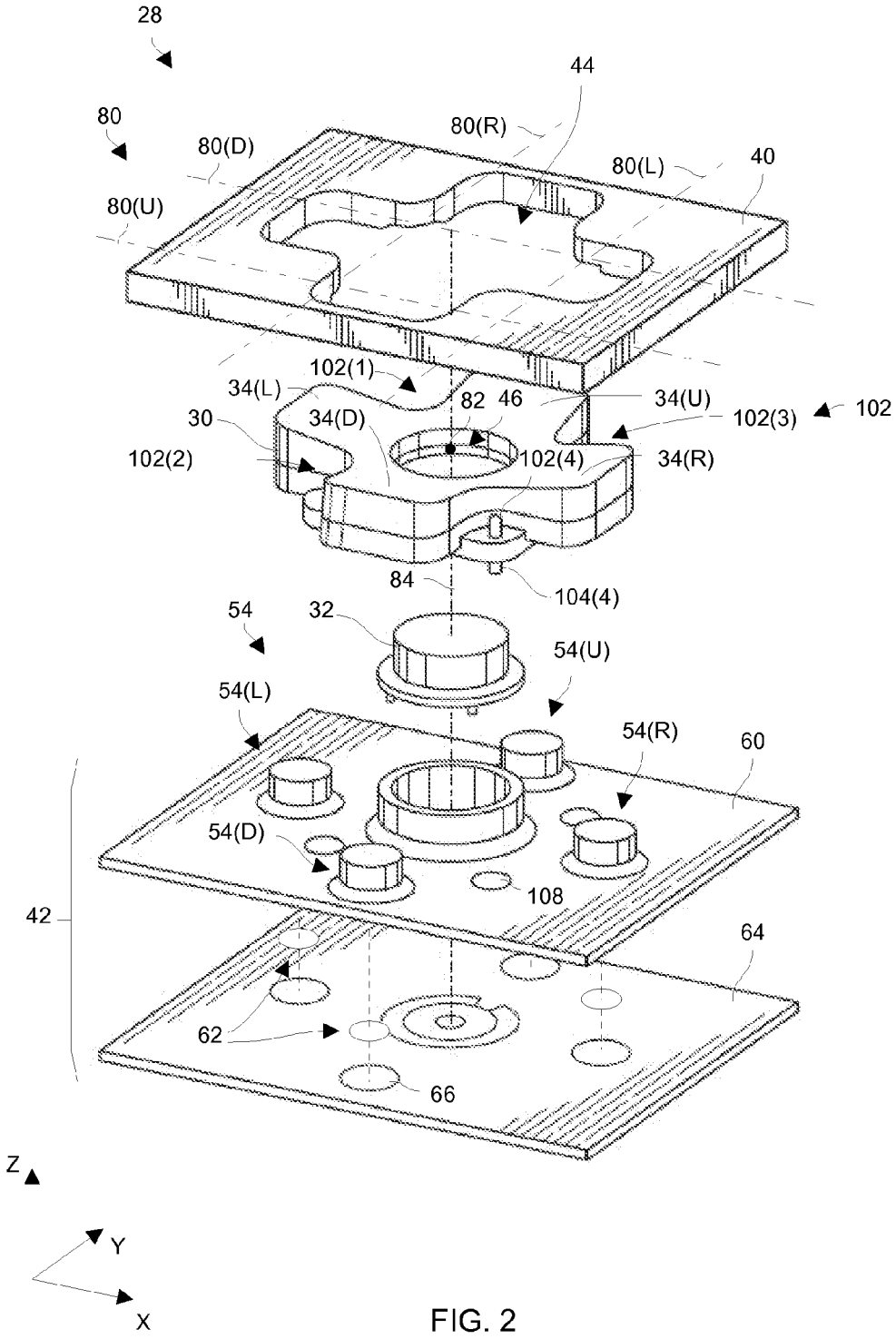
FIG. 2 is an exploded view of a portion of the navigation button assembly of the electronic apparatus of FIG. 1 from a first angle.
Figure 3:
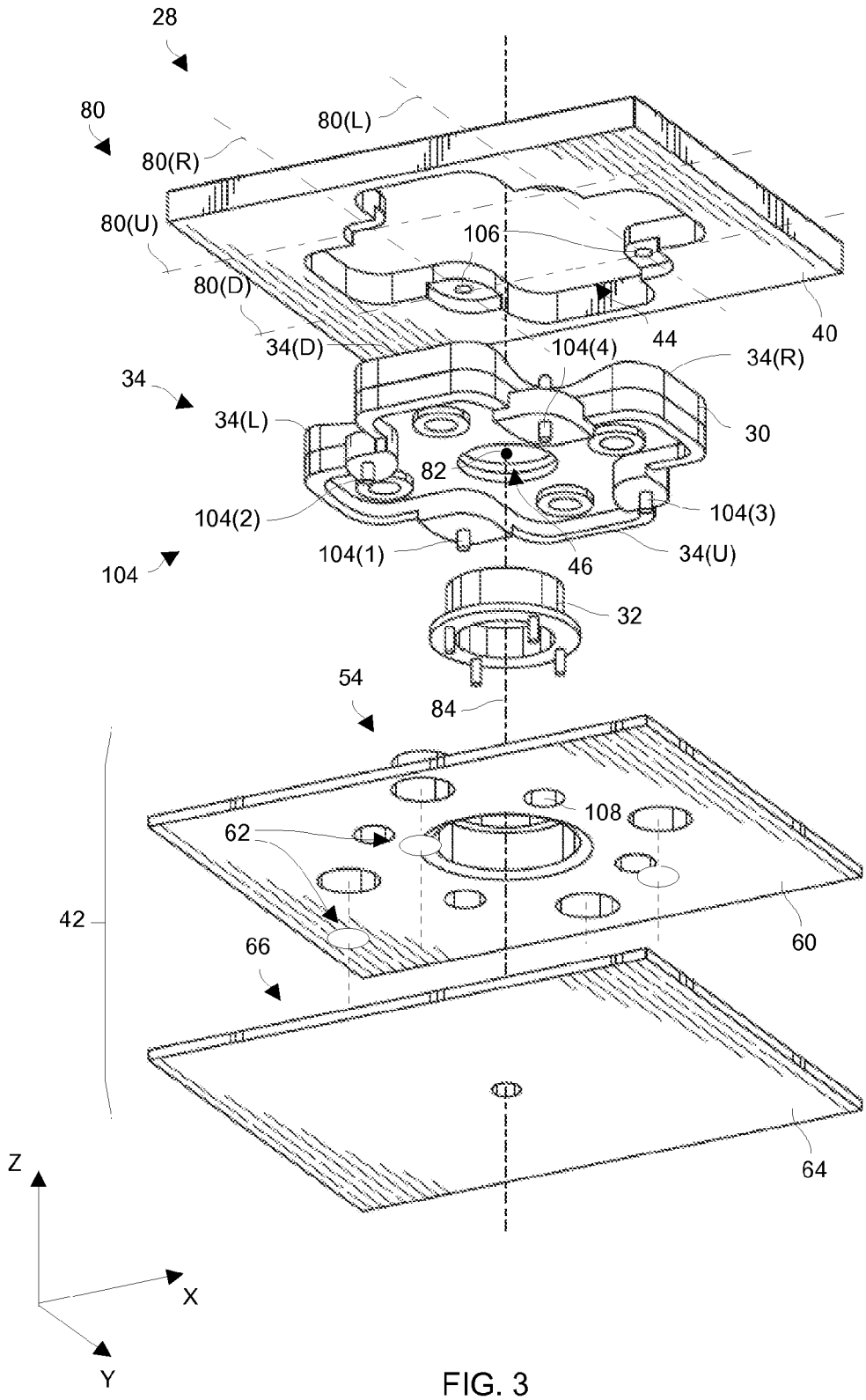
FIG. 3 is an exploded view of the portion of the navigation button assembly of FIG. 2 from a second angle.

FIGS. 2 and 3 provide exploded views of a portion of the navigation button assembly 28. FIG. 2 is a view from an elevated angle. FIG. 3 is a view from an angle below.

As shown in FIGS. 2 and 3, the navigation button assembly 28 includes a cover 40, the navigation button 30 (FIG. 1), the selection button 32 (FIG. 1), and an electronic device 42. The cover 40 may be part of a housing of the electronic apparatus 20 or separate from the housing (e.g., a face plate). Similarly, the electronic device 42 may be part of a larger component of the electronic apparatus 20 (e.g., a motherboard assembly) or a separate portion (e.g., a discrete printed circuit board assembly, a daughter board, etc.).

The cover 40 extends in the X-Y plane and defines an aperture 44 through which the navigation button 30 and the selection button 32 extend when the navigation button assembly 28 is in its assembled state. Similarly, the navigation button 30 defines a central opening 46 through which the selection button 32 extends. In some arrangements, the selection button 32 is transparent or semi-transparent to enable the user to view light therethrough for added functionality.

The electronic device 42 provides a set of depressible controls 54(U), 54(D), 54(L), and 54(R) (collectively, depressible controls 54) which correspond to the directional lobes 34(U), 34(D), 34(L) and 34(R) of the navigation button 30. When the navigation button assembly 28 is in an assembled state, the depressible controls 54(U), 54(D), 54(L), and 54(R) reside directly under the directional lobes 34(U), 34(D), 34(L) and 34(R), respectively.

As further shown in FIGS. 2 and 3, the electronic device 42 includes an elastomeric pad 60, a set of conductive members 62, and a printed circuit board section 64. Each conductive member 62 (e.g., a puck, a disk, a pad, etc. made of conductive material) is held by the elastomeric pad 60 at a respective location over a respective contact site 66 of the printed circuit board section 64, e.g., see the depressible control 54(D) in FIG. 2. Each contact site 66 includes a set of electrical contacts (e.g., metallic pads, fingers, etc.). In some arrangements, the elastomeric pad 60 is appropriately contoured to precisely position the conductive members 62 over their respective contact sites 66 (see dashed lines which illustrate axial alignment in the Z-direction). Accordingly, the depressible controls 54 operate as pushbutton switches. In particular, for each depressible control 54, the conductive member 62 is normally out of contact with the respective contact site 66, i.e., in an opened state when the depressible control 54 is not actuated. However, when a depressible control 54 is actuated, the conductive member 62 contacts the contact site 66, i.e., a closed state.

In some arrangements, a conductive member 62 (e.g., a conductive ring) resides underneath the selection button 32 and is held in place by the elastomeric pad 60. Accordingly, when the selection button 32 is pressed, the selection button 32 moves that conductive member 62 into contact with a respective selection contact site 66 of the printed circuit board section 64 to provide selection input from the user.

As will be explained in further detail shortly, the navigation button 30 is constructed and arranged to pivot about one of four different axes 80(R), 80(L), 80(D), and 80(U) (collectively, axes 80) with respect to the cover 40 depending on which directional lobe 34 the user presses. Along these lines, the cover 40 provides support to the navigation button 30 during user operation. In particular, when the user presses on a particular directional lobe 34, the navigation button 30 pivots about one of the four axes 80 to actuate the depressible control 54 which is directly beneath the particular directional lobe 34 in the negative Z-direction without actuating any of the other depressible controls 54. That is, only the depressible control 54 directly under the depressed directional lobe 34 transitions from the opened state to the closed state. All other depressible controls 54 remain in the opened state. Such an arrangement alleviates the need for a programmed processor to compare resistances from resistance-varying sensors as in a conventional 4-way navigation mechanism.

It should be understood that each axis 80 is offset from a midpoint (or midline) 82 of the navigation button 30. A center axis 84 along the Z-direction assists in identifying the midpoint 82 of the navigation button 30 within the X-Y plane defined by the navigation button 30. In particular, the axes 80(R) and 80(L) are substantially parallel to each other and positioned off the midpoint 82 of the navigation button 30 (i.e., a predefined distance from the midpoint 82 such as between 1.0 to 8.0 mm). Similarly, axes 80(U) and 80(D) are substantially parallel to each other and positioned off the midpoint 82 of the navigation button 30. Furthermore, it should be understood that axes 80(R) and 80(L) are substantially perpendicular to axes 80(U) and 80(D). Further details will now be provided with reference to FIGS. 4 and 5.

Figure 4:
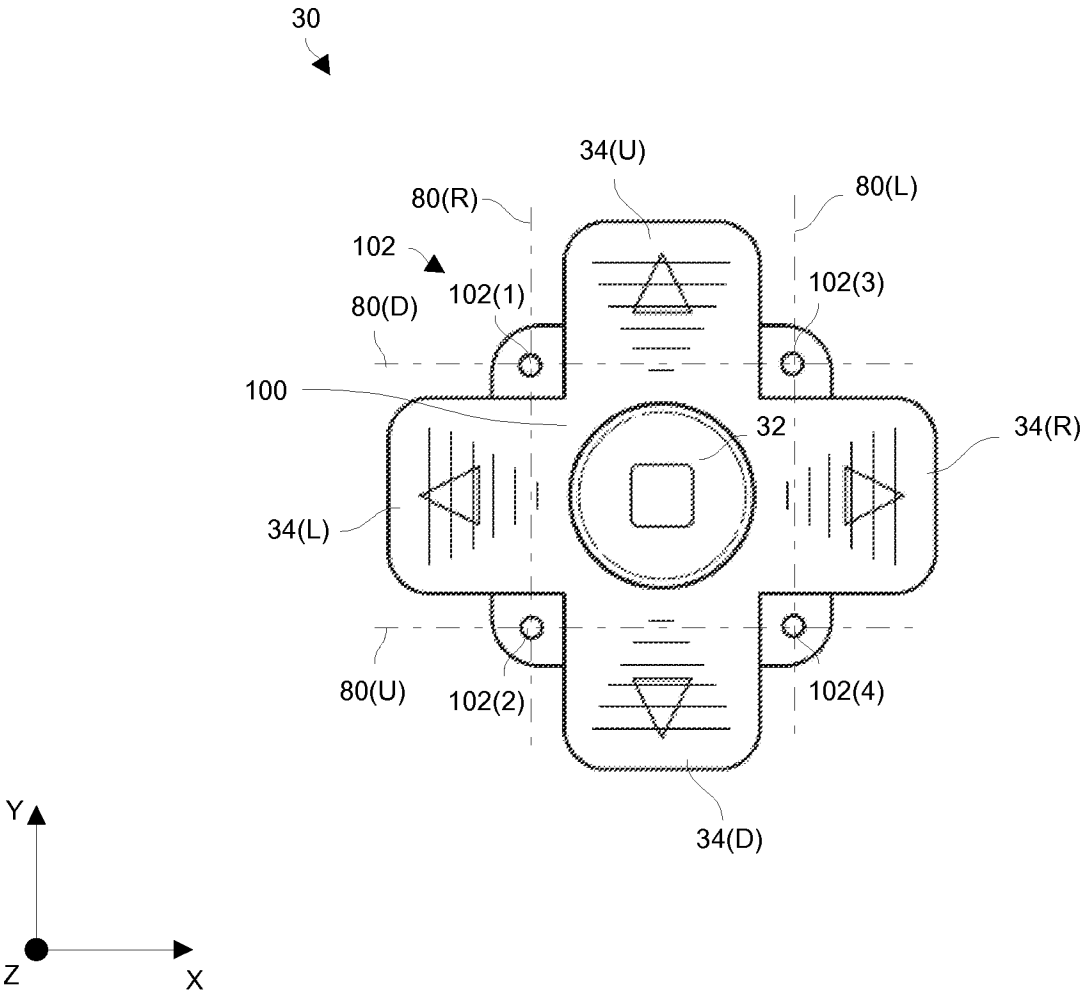
FIG. 4 is a top view of a navigation button of the navigation button assembly of FIG. 1.
Figure 5:
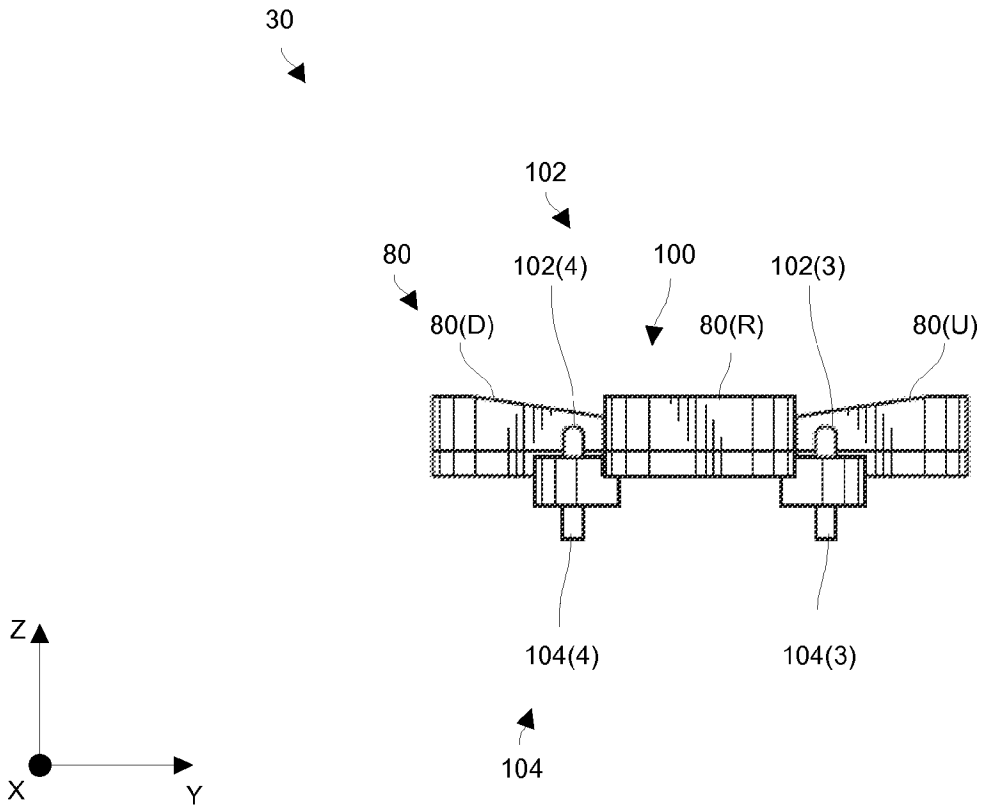
FIG. 5 is a side view of a navigation button of the navigation button assembly of FIG. 1.

FIGS. 4 and 5 show particular details of the navigation button 30. FIG. 4 is a top view of the navigation button 30. FIG. 5 is a side view of the navigation button 30.

In addition to the directional lobes 80 (FIGS. 1-3), the navigation button 30 further includes a central portion 100 (FIG. 4), a set of pivot pointers 102(1), 102(2), 102(3), and 102(4) (collectively, pivot pointers 102), and a set of stop pointers 104(1), 104(2), 104(3), and 104(4) (collectively, stop pointers 104). The navigation button 30 is generally planar in shape in the X-Y plane, and the directional lobes 80 extend radially from the central portion 100 along the X and Y axes (FIG. 4). Additionally, each pivot pointer 102 extends from the central portion 100 in the positive Z-direction toward the cover 40 (FIGS. 2, 4 and 5). Similarly, each stop pointer 104 extends from the central portion 100 in the negative Z-direction toward the printed circuit board section 64 (FIGS. 2, 3 and 5).

Details of how the navigation button 30 pivots within the navigation button assembly 28 will now be provided with reference to FIGS. 2 through 5. When the navigation button assembly 28 is in its fully assembled form and in an initial state (i.e., not being operated by the user), the four pivot pointers 102 of the navigation button 30 reside in four corresponding pivot domes 106 defined by the cover 40 (also see FIG. 3). Additionally, the four stop pointers 104 reside in four corresponding dimples 108 of the elastomeric pad 60 (also see FIGS. 2 and 3), and elasticity from the elastomeric pad 60 biases the navigation button 30 as well as the selection button 32 in the positive Z-direction. Accordingly, none of the depressible controls 54 is actuated while the navigation button assembly 28 is in its initial state, and the navigation button 30 is robustly and reliably held in place relative to the cover 40 and the elastomeric pad 60. As a result, the navigation button 30 is unable to translate in the X-Y plane. Similarly, the selection button 32 is unable to translate relative to the navigation button 30 in the X-Y plane.

Suppose that the user then depresses the directional lobe 34(R) in order to direct navigation to the right (i.e., the positive X-direction). The navigation button 30 pivots about the axis 80(R) which is adjacent the directional lobe 34(L) (FIGS.

2 and 3). In particular, the directional lobe 34(R) moves in the negative Z-direction and the directional lobe 34(L) moves slightly in the positive Z-direction. Accordingly, the pivot pointers 102(3) and 102(4) which are adjacent the directional lobe 34(R) escape from their respective pivot domes 106 while the pivot pointers 102(1) and 102(2) continue to reside within their respective pivot domes 106 (FIG. 3). Eventually, the directional lobe 34(R) actuates the depressible control 54(R) residing directly underneath the directional lobe 34(R), and the stop pointers 104(3) and 104(4) contact the printed circuit board section 64 through the dimples 108 of the elastomeric pad to prevent further rotation of the navigation button 30 about the axis 80(R). As a result, there is no actuation of any of the depressible controls 54 other than the depressible control 54(R).

It should be understood that the dimensions of the operating components can be set to reliably prevent inadvertent actuation of adjacent depressible controls 54. In particular, the distance of the axis 80(R) from the button midpoint 82 (or midline) and the height of the pointers 102, 104 can be set appropriately and kept at tight tolerances to prevent the directional lobes 34(U), 34(D), which are adjacent to the directional lobe 34(R) that is being depressed, from actuating the adjacent depressible controls 54(U), 54(D).

It should be further understood that the actuation travel distance of the depressible controls 54 under the directional lobes 34 can be set less than the actuation travel distance of the depressible control 54 under the selection button 32. Such an arrangement ensures that the depressible control 54 under the selection button 32 is never activated when the user depresses any of the directional lobes 34 of the navigation button 30.

When the user no longer presses on the directional lobe 34(R), the navigation button 30 returns to its original position due to biasing from the elastomeric pad 60. Accordingly, the depressible control 54(R) returns to its non-actuated state.

Now suppose that the user subsequently depresses the directional lobe 34(L) in order to direct navigation to the left (i.e., the negative X-direction). The navigation button 30 pivots about the axis 80(L) which is adjacent the directional lobe 34(R) (e.g., see FIGS. 2 and 3). In particular, the directional lobe 34(L) moves in the negative Z-direction and the directional lobe 34(R) moves slightly in the positive Z-direction. That is, the pivot pointers 102(1) and 102(2) which are adjacent the directional lobe 34(L) (i.e., one pair of pivot pointers 102) escape from their respective pivot domes 106 while the pivot pointers 102(3) and 102(4) continue to reside within their respective pivot domes 106 (i.e., another pair of pivot pointers 102). Eventually, the directional lobe 34(L) actuates the depressible control 54(L) residing directly underneath the directional lobe 34(L), and the stop pointers 104(1) and 104(2) contact the surface of the printed circuit board section 64 through the dimples 108 of the elastomeric pad to prevent further rotation of the navigation button 30 about the axis 80(L). Accordingly, there is no actuation of any of the depressible controls 54 other than the depressible control 54(L) and thus no multi-touch error.

At this point, it should be understood that offsetting separate pivot axes 80(R) and 80(L) from the button midpoint 82 enables precise control over the pivot action of the navigation button 30 to prevent actuation of multiple depressible controls 54 in response to depression of a directional lobe 34(R), 34(L). Specifically, the navigation button 30 easily avoids actuating adjacent depressible controls 54(U), 54(D) when actuating only the depressible control 54(R) or 54(L) directly underneath the depressed directional lobe 34(R) or 34(L).

It should be further understood that the navigation button assembly 28 operates in similar manners when the user presses on the directional lobes 34(U), 34(D). For example, when the user presses on the directional lobe 34(U), the navigation button pivots about the axis 80(U) which is adjacent the directional lobe 34(D) and offset from the midpoint 82 (see FIGS. 2 and 3) to actuate the depressible control 54(U) without actuating any of the other depressible controls 54. Similarly, when the user presses on the directional lobe 34(D), the navigation button pivots about the off-centered axis 80(D) which is adjacent the directional lobe 34(U) to actuate the depressible control 54(*d*) without actuating any of the other depressible controls 54.

As described above, a multi function navigational switch 28 includes an electronic device 42 having depressible controls 54, a cover 40 disposed in a fixed position relative to the electronic device 42, and a navigation button 30 which is positioned over the electronic device 42 by the cover 40 (or similarly provisioned support member). The navigation button 30 has a central portion 100, and directional lobes 34 extending from the central portion 100. The navigation button 30 initially resides in a non-pivoting orientation in which none of the depressible controls 54 are actuated. The navigation button 30 (i) pivots about a first axis 80 relative to the cover 40 in response to depression of a first directional lobe 34 to actuate a first depressible control 54 of the electronic device 42 without actuating a second depressible control 54 of the electronic device 42, and (ii) pivots about a second axis 80 relative to the cover 40 in response to depression of a second directional lobe 34 to actuate the second depressible control 54 of the electronic device 42 without actuating the first depressible control 54 of the electronic device 42.

While various embodiments of the invention have been particularly shown and described, it will be understood by those skilled in the art that various changes in form and details may be made therein without departing from the spirit and scope of the invention as defined by the appended claims.

For example, the electronic apparatus 20 was described above as a telephone by way of example. It should be understood that other apparatus are suitable as well such as a smart phone, a general controller for a computerize device, and so on.

What is claimed is:

1. An assembly, comprising:

an electronic device having a set of depressible controls;

a support disposed in a fixed position relative to the electronic device; and a navigation button which is positioned over the electronic device by the support, the navigation button including (i) a central portion, and (ii) directional lobes extending from the central portion, the navigation button being constructed and arranged to:

initially reside in a non-pivoting orientation in which none of the depressible controls are actuated, pivot about a first axis relative to the support in response to depression of a first directional lobe to actuate a first depressible control of the electronic device without actuating a second depressible control of the electronic device, and pivot about a second axis relative to the support in response to depression of a second directional lobe to actuate the second depressible control of the electronic device without actuating the first depressible control of the electronic device, each of the first axis and the second axis being offset from a midpoint of the navigation button, wherein the first axis is adjacent the second directional lobe;

wherein the second axis is adjacent the first directional lobe;

wherein the first axis and the second axis are substantially parallel to each other;

wherein the support defines a first set of pivot domes and a second set of pivot domes; and wherein the navigation button further includes:

a first set of pivot pointers adjacent the second directional lobe, and a second set of pivot pointers adjacent the first directional lobe, the first set of pivot pointers pivoting within the first set of pivot domes and the second set of pivot pointers escaping from the second set of pivot domes in response to depression of the first directional lobe, and the second set of pivot pointers pivoting within the second set of pivot domes and the first set of pivot pointers escaping from the first set of pivot domes in response to depression of the second directional lobe.

2. An assembly as in claim 1 wherein the navigation button is further constructed and arranged to:

pivot about a third axis relative to the support in response to depression of a third directional lobe to actuate a third depressible control of the electronic device without actuating a fourth depressible control of the electronic device, and pivot about a fourth axis relative to the support in response to depression of a fourth directional lobe to actuate the fourth depressible control of the electronic device without actuating the third depressible control of the electronic device.

3. An assembly as in claim 2 wherein the third axis is adjacent the fourth directional lobe;

wherein the fourth axis is adjacent the third directional lobe; and wherein the third axis and the fourth axis are substantially parallel to each other.

4. An assembly as in claim 3 wherein the first axis and the second axis are substantially perpendicular to the third axis and the fourth axis.

5. An assembly as in claim 3 wherein the first, second, third and fourth axes reside in a plane defined by the support; and wherein the navigation button is further constructed and arranged to:

return to the non-pivoting orientation when the navigation button is no longer depressed, a plane defined by the navigation button being substantially parallel to the plane defined by the support when the navigation button is no longer depressed.

6. An assembly as in claim 3 wherein the electronic device includes:

at least a portion of a printed circuit board, an elastomeric pad, and a set of conductive members, the elastomeric pad being constructed and arranged to hold each conductive member at a respective location relative to the portion of the printed circuit board to form, as a depressible control, a pushbutton switch which is in (i) closed state when actuated and (ii) an open state when released.

7. An assembly as in claim 3 wherein the electronic device defines a four pivot domes;

wherein the navigation button further includes four pivot pointers coupled to the central portion;

wherein, in response to depression of the first directional lobe, a first pair of pivot pointers pivots within a first pair of pivot domes and a second pair of pivot pointers escapes from a second pair of pivot domes;

wherein, in response to depression of the second directional lobe, the second pair of pivot pointers pivots within the second pair of pivot domes and the first pair of pivot pointers escapes from the first pair of pivot domes; and wherein all of the pivot pointers of the first pair are different than all of the pivot pointers of the second pair.

8. An assembly as in claim 7 wherein, in response to depression of the third directional lobe, a third pair of pivot pointers pivots within a third pair of pivot domes and a fourth pair of pivot pointers escapes from a fourth pair of pivot domes;

wherein, in response to depression of the fourth directional lobe, the fourth pair of pivot pointers pivots within the fourth pair of pivot domes and the third pair of pivot pointers escapes from the third pair of pivot domes; and wherein all of the pivot pointers of the third pair are different than all of the pivot pointers of the fourth pair.

9. An assembly as in claim 8 wherein a first pivot pointer belongs to the first pair and the third pair;

wherein a second pivot pointer belongs to the first pair and the fourth pair; wherein a third pivot pointer belongs to the second pair and the third pair; and wherein a fourth pivot pointer belongs to the third pair and the fourth pair.

10. An assembly as in claim 8 wherein the navigation button further includes:

a set of stop pointers coupled to the central portion, each stop pointer being constructed and arranged to prevent further pivoting of the navigation button when that stop pointer contacts the electronic device.

11. An assembly as in claim 3 wherein the central portion of the navigation button defines a central opening; and wherein the navigation button assembly further comprises:

a selection button which is held in place relative to the electronic device by the central portion of the navigation button, at least part of the selection button extending through the central opening defined by the central portion of the navigation button.

12. An assembly as in claim 11 wherein the navigation button is constructed and arranged to pivot relative to the support in response to directional user input applied to the directional lobes; and wherein the selection button is constructed and arranged to depress relative to the navigation button in response to selection user input applied to a top of the selection button.

13. The assembly of claim 1, wherein the navigation button has a central portion, and wherein the first set of pivot pointers and the second set of pivot pointers extend from the central portion of the navigation button.

14. The assembly of claim 13, wherein each pair of adjacent directional lobes forms a corner, wherein the central portion of the navigation button includes a corner portion disposed at each corner, and wherein each of the first set of pivot pointers extends from a respective corner portion within the central portion of the navigation button.

15. The assembly of claim 14, wherein each of the second set of pivot pointers extends from a respective corner portion within the central portion of the navigation button.

16. The assembly of claim 1, wherein the navigation button has a central axis, wherein the first depressible control and each of the second set of pivot pointers are disposed at substantially the same radial distance from the central axis.

17. The assembly of claim 16, wherein the second depressible control is disposed at substantially the same radial distance from the central axis as the first depressible control, and wherein each of the first set of pivot pointers is disposed at substantially the same radial distance from the central axis as each of the second set of pivot pointers.

18. An apparatus, comprising:

a base; and a navigation button assembly coupled to the base, the navigation button assembly including:

an electronic device having a set of depressible controls, a support disposed in a fixed position relative to the electronic device, and a navigation button which is positioned over the electronic device by the support, the navigation button including (i) a central portion, and (ii) directional lobes extending from the central portion, the navigation button being constructed and arranged to:

initially reside in a non-pivoting orientation in which none of the depressible controls are actuated, pivot about a first axis relative to the support in response to depression of a first directional lobe to actuate a first depressible control of the electronic device without actuating a second depressible control of the electronic device, and pivot about a second axis relative to the support in response to depression of a second directional lobe to actuate the second depressible control of the electronic device without actuating the first depressible control of the electronic device, each of the first axis and the second axis being offset from a midpoint of the navigation button, wherein the first axis is adjacent the second directional lobe;

wherein the second axis is adjacent the first directional lobe;

wherein the first axis and the second axis are substantially parallel to each other;

wherein the support defines a first set of pivot domes and a second set of pivot domes; and wherein the navigation button further includes:

a first set of pivot pointers adjacent the second directional lobe, and a second set of pivot pointers adjacent the first directional lobe, the first set of pivot pointers pivoting within the first set of pivot domes and the second set of pivot pointers escaping from the second set of pivot domes in response to depression of the first directional lobe, and the second set of pivot pointers pivoting within the second set of pivot domes and the first set of pivot pointers escaping from the first set of pivot domes in response to depression of the second directional lobe, the apparatus further comprising an electronic display coupled to the base, wherein the electronic device includes circuitry in electrical communication with the electronic display, the circuitry being constructed and arranged to provide a user with a set of selectable electronic features which are displayed to the user by the electronic display, and which are highlighted and selected via user operation of the navigation button assembly.

19. An apparatus as in claim 18 wherein the navigation button is further constructed and arranged to:

pivot about a third axis relative to the support in response to depression of a third directional lobe to actuate a third depressible control of the electronic device without actuating a fourth depressible control of the electronic device, and pivot about a fourth axis relative to the support in response to depression of a fourth directional lobe to actuate the fourth depressible control of the electronic device without actuating the third depressible control of the electronic device.

20. An apparatus as in claim 19 wherein the third axis is adjacent the fourth directional lobe;

wherein the fourth axis is adjacent the third directional lobe; and wherein the third axis and the fourth axis are substantially parallel to each other.

* * * * *